US011174811B2

(12) United States Patent
Marrack

(10) Patent No.: US 11,174,811 B2
(45) Date of Patent: Nov. 16, 2021

(54) FUEL SYSTEM CONFIGURED FOR BACK END RATE SHAPING USING MECHANICALLY ACTUATED FUEL INJECTOR

(71) Applicant: Caterpillar Inc., Peoria, IL (US)

(72) Inventor: Andrew Ogden Marrack, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/733,025

(22) Filed: Jan. 2, 2020

(65) Prior Publication Data

US 2021/0207554 A1 Jul. 8, 2021

(51) Int. Cl.
*F02M 45/00* (2006.01)
*F02D 41/34* (2006.01)
*F02M 47/02* (2006.01)

(52) U.S. Cl.
CPC ..... *F02D 41/345* (2013.01); *F02M 47/027* (2013.01)

(58) Field of Classification Search
CPC ..... F02M 47/027; F02D 41/345
See application file for complete search history.

(56) References Cited

U.S. PATENT DOCUMENTS 4,407,241 A * 10/1983 Butler ..... F01L 1/2422 123/501
5,372,114 A * 12/1994 Gant ..... F01L 1/2411 123/502
5,517,972 A 5/1996 Stockner
5,619,969 A 4/1997 Liu et al.
5,713,520 A * 2/1998 Glassey ..... F02M 47/027 239/124
6,412,705 B1 * 7/2002 Desai ..... F02M 45/066 123/446
6,513,371 B1 2/2003 Jett et al.
6,637,675 B2 * 10/2003 Carroll, III ..... F02M 45/086 239/124
6,705,543 B2 * 3/2004 Carroll, III ..... F02M 45/04 239/124
6,935,580 B2 8/2005 Azam et al.
6,966,040 B2 * 11/2005 Ismailov ..... F02D 41/20 703/2
6,978,770 B2 12/2005 Rauznitz et al.
7,059,301 B2 * 6/2006 Stockner ..... F02M 45/00 123/446
7,134,616 B2 * 11/2006 Dong ..... F02M 57/02 239/533.8
7,334,741 B2 * 2/2008 Benson ..... F02M 45/083 123/496
8,881,709 B2 11/2014 Kim et al.
9,562,505 B2 2/2017 Hokkanen et al.
10,066,563 B2 9/2018 Jalel
2011/0048379 A1 3/2011 Sommars et al.

* cited by examiner

*Primary Examiner* — Gonzalo Laguarda
(74) *Attorney, Agent, or Firm* — Brannon Sowers & Cracraft

(57) ABSTRACT

A fuel system includes a mechanically actuated fuel injector having a spill valve assembly and a control valve assembly. A rate shaping control unit is coupled with a spill valve actuator and a control valve actuator, and structured to adjust a dwell time, cycle to cycle, between opening of a spill valve and closing of a check control valve. Adjusting the dwell time enables varying a back end rate shape, cycle to cycle, of fuel injections from a fuel injector into a cylinder in an internal combustion engine.

19 Claims, 5 Drawing Sheets

FUEL SYSTEM CONFIGURED FOR BACK END RATE SHAPING USING MECHANICALLY ACTUATED FUEL INJECTOR

TECHNICAL FIELD

The present disclosure relates generally to fuel injection rate shaping, and more particularly to back end rate shaping in a mechanically actuated fuel injector.

BACKGROUND

Most modern internal combustion engines include electronically controlled fuel injection, employing rapidly moving valve components to precisely control factors such as start of injection timing, end of injection timing, and others. Precise control over such timings, fuel injection pressure, and other factors are principal techniques for limiting certain emissions from internal combustion engines.

In recent years, a property of fuel injection known as rate shape has been observed to be of particular interest in promoting combustion in a manner that satisfies increasingly stringent emissions standards. Injection rate shape can be generally understood as the variation in the rate of fuel injection through nozzle outlet, and the shape of a curve defined thereby. Certain patterns of variation in the injection rate result in characteristic shapes, including ramp-shaped injections, square injections, and still others. Engineers have also experimented with many different ways to split injections into more than one discrete pulse of injected fuel, provide pre-injections or pilot injections, post-injections, and still others. One known fuel injector structured for rate shaping is set forth in U.S. Pat. No. 6,935,580 to Azam et al. Azam et al. propose a valve assembly having at least one valve member movable between a plurality of positions to control fluid communication between inlets and outlets, ostensibly for the purpose of producing various front end rate shapes. Other rate shapes, including back end rate shapes, have proven challenging to produce in at least certain types of fuel systems.

SUMMARY OF THE INVENTION

In one aspect, a fuel system includes a fuel injector having an injector housing having formed therein each of a fuel inlet passage, a low pressure outlet, a plunger cavity, a check control chamber, and a nozzle supply passage extending between the plunger cavity and a nozzle outlet. The fuel injector further includes a plunger having a tappet and being movable between a retracted position, and an advanced position in the plunger cavity, a spill valve assembly including a spill valve electrical actuator, and a spill valve positioned fluidly between the plunger cavity and the fuel inlet passage. The fuel injector further includes a direct-operated nozzle check positioned fluidly between the nozzle supply passage and the nozzle outlet, and a check control valve assembly including a control valve electrical actuator and a check control valve positioned fluidly between the check control chamber and the low pressure outlet. The fuel system further includes a rate shaping control unit coupled with the spill valve electrical actuator and with the control valve electrical actuator. The rate shaping control unit is structured to command a change to an electrical energy state of the spill valve electrical actuator to open the spill valve, and to command a change to an electrical energy state of the control valve electrical actuator to close the check control valve. The rate shaping control unit is still further structured to adjust a dwell time, cycle to cycle, between the opening of the spill valve and the closing of the check control valve, and to vary a back end rate shape, cycle to cycle, of fuel injections from the fuel injector into a cylinder in an engine based on the adjustment to the dwell time.

In another aspect, a method of operating a fuel system for an internal combustion engine includes advancing a plunger in a plunger cavity in a fuel injector in response to rotation of a cam. The method further includes closing a spill valve in the fuel injector to initiate pressurizing fuel in the plunger cavity during the advancing of the plunger, and opening a direct-operated nozzle check in the fuel injector to start injection of pressurized fuel from the fuel injector. The method further includes opening the spill valve to end pressurizing fuel in the plunger cavity, and closing the direct-operated nozzle check to end injection of pressurized fuel from the fuel injector. The method still further includes adjusting, cycle to cycle, a timing of the opening of the spill valve relative to a timing of the closing of the direct-operated nozzle check, and varying, cycle to cycle, a back end rate shape of fuel injections from the fuel injector based on the adjustment to the timing of the opening of the spill valve relative to the timing of the closing of the direct-operated nozzle check.

In still another aspect, a fuel control system for an internal combustion engine includes a rate shaping control unit structured to couple with each of a spill valve electrical actuator and a control valve electrical actuator in a mechanically actuated fuel injector in a fuel system. The rate shaping control unit is further structured to command energizing the spill valve electrical actuator to block a plunger cavity from a fuel inlet passage in the fuel injector, and to command deenergizing the spill valve electrical actuator to fluidly connect the plunger cavity to the fuel inlet passage. The rate shaping control unit is further structured to command energizing the control valve electrical actuator to fluidly connect a check control chamber to a low pressure outlet in the fuel injector, and to command deenergizing the control valve electrical actuator to block the check control chamber from the low pressure outlet. The rate shaping control unit is further structured to adjust a dwell time, cycle to cycle, between the commanded deenergizing of the control valve electrical actuator and the commanded deenergizing of the spill valve electrical actuator, and vary a back end rate shape, cycle to cycle, of fuel injections from a fuel injector into a cylinder in the internal combustion engine based on the adjustment to the dwell time.

DETAILED DESCRIPTION

Figure 1:
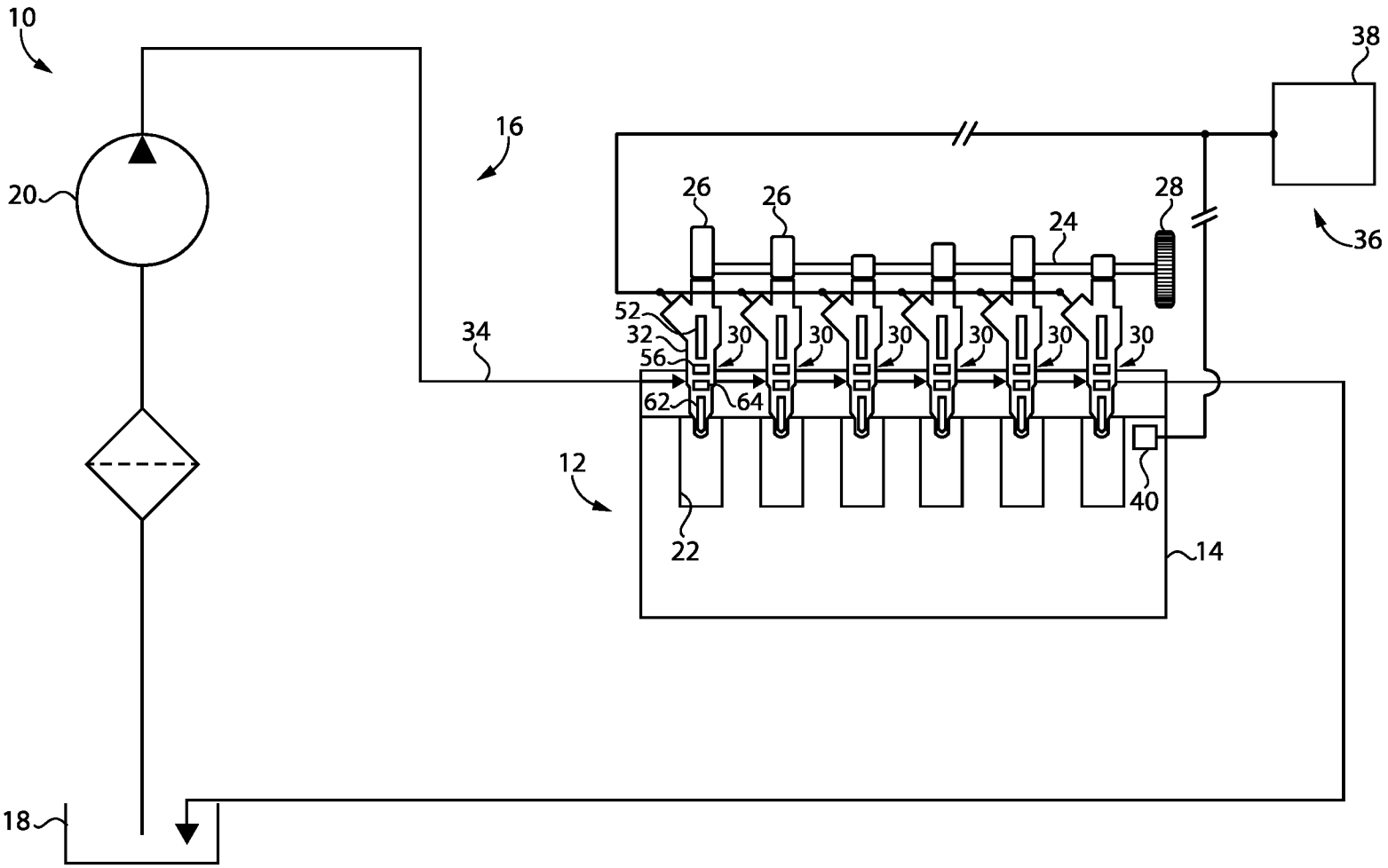
FIG. 1 is a diagrammatic view of an internal combustion engine system, according to one embodiment.

Referring to FIG. 1, there is shown an internal combustion engine system 10 according to one embodiment, and including an internal combustion engine 12 having an engine housing 14. Internal combustion engine 12 can include a compression-ignition diesel engine, although the present disclosure is not thereby limited. A plurality of cylinders 22 are formed in engine housing 14, and can include any number of cylinders in any suitable arrangement. Internal combustion engine system 12 further includes a fuel system 16 having a fuel tank 18, a fuel pump 20, and a plurality of fuel injectors 30. Fuel system 16 also includes a camshaft 24 having a plurality of cams 26, and a cam gear 28 structured to couple with an engine gear train. A plurality of pistons (not shown) are positioned to reciprocate in cylinders 22 between a top dead center position and a bottom dead center position in a conventional four-cycle pattern, although the present disclosure is not thereby limited. Fuel pump 20 feeds fuel by way of a fuel supply line 34 to engine housing 14 and thenceforth to fuel injectors 30. Fuel injectors 30 may be mechanically actuated and each structured to pressurize a fuel for injection by way of rotation of cams 26. Each fuel injector 30 also includes a spill valve assembly 56, a plunger 52, a direct-operated nozzle check 62, and a check control valve assembly 64. Fuel injectors 30 may each include an injector housing 32 extending into a corresponding one of cylinders 22 for direct injection of liquid fuel. Internal combustion engine system 10 also includes a fuel control system 36 having a rate shaping control unit 38, and one or more engine state sensors 40. It should be appreciated that description of any one component of internal combustion engine system 10 in the singular is understood to refer by way of analogy to any similar components. As will be further apparent from the following description, fuel system 16 may be structured for back end rate shaping of fuel injections from fuel injectors 30 into cylinders 22.

Figure 2:
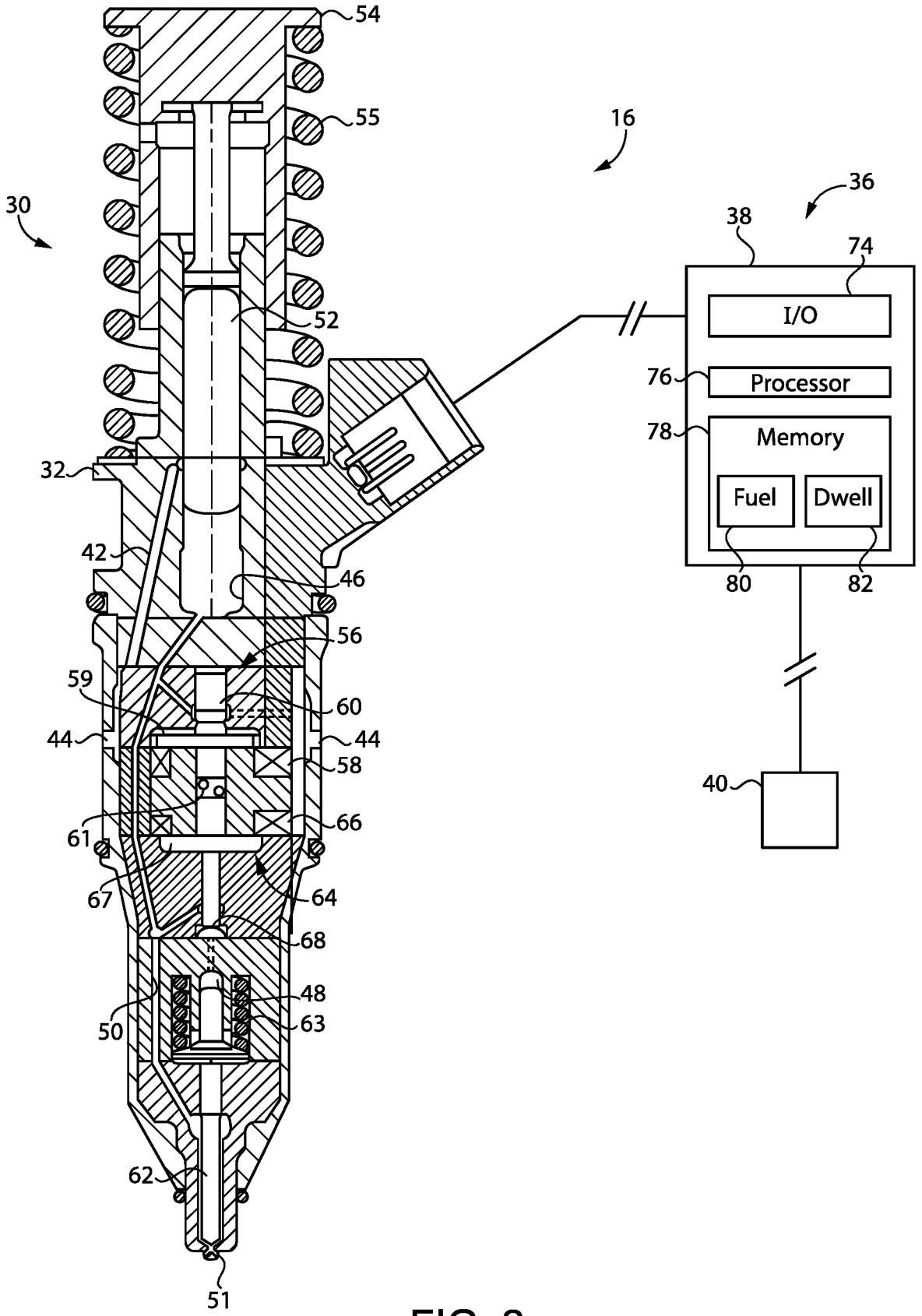
FIG. 2 is a diagrammatic view, partially sectioned, of portions of a fuel system, according to one embodiment.

Referring also now to FIG. 2, there are shown features of fuel system 16, including fuel injector 30, in greater detail. As noted above, fuel injector 30 includes an injector housing 32, with injector housing 32 having formed therein each of a fuel inlet passage 42, a low pressure outlet 44, a plunger cavity 46, a check control chamber 48, and a nozzle supply passage 50 extending between plunger cavity 46 and a nozzle outlet 51, typically a plurality of nozzle outlets. Also shown in FIG. 2 is plunger 52, having a tappet 54 structured to contact one of rotatable cams 26. A return spring 55 is coupled between injector housing 32 and tappet 54. Plunger 52 is movable between a retracted position, and an advanced position in plunger cavity 46. Spill valve assembly 56 includes a spill valve electrical actuator 58, an armature 59, and a spill valve 60 positioned fluidly between plunger cavity 46 and fuel inlet passage 42. A spill valve return spring 61 is positioned to bias armature 59 in opposition to a magnetic attraction force produced by spill valve electrical actuator 58. Direct-operated nozzle check 62, which may be a conventional needle check, is positioned fluidly between nozzle supply passage 50 and nozzle outlet 51. A check return spring is shown at numeral 63, biasing direct-operated nozzle check 62 toward a closed position. At the closed position nozzle check 62 blocks nozzle outlet 51 from nozzle supply passage 50. Check control valve assembly 64 includes a control valve electrical actuator 66, an armature 67, and a control valve 68 positioned fluidly between check control chamber 38 and low pressure outlet 44. Spring 63, or an assembly of springs, can bias check control valve 68 toward a closed position where check control chamber 48 is blocked from low pressure outlet 44. In the illustrated embodiment low pressure outlet 44 is the same fuel port that supplies fuel into fuel injector 30, such as in response to movement of plunger 52 from an advanced position toward a retracted position. In other instances, a separate low pressure outlet could be used.

During operation when spill valve 60 is closed plunger 52 will more or less passively reciprocate to draw fuel in through fuel inlet passage 42, and spill fuel out of fuel injector 30 back through fuel inlet passage 42. When spill valve 60 is actuated closed, fluid communication between plunger cavity 46 and low pressure outlet 44 is blocked, and advancing of plunger 52 toward an advanced position through plunger cavity 46 will pressurize fuel for injection. So long as direct-operated nozzle check 62 remains closed, fuel will be pressurized but not injected, until such time as direct-operated nozzle check 62 is opened. The opening and closing of direct-operated nozzle check 62 by way of actuating control valve assembly 64 is a generally known process. When spill valve 60 is returned to an open position, fuel pressurization will cease, and advancement of plunger 52 will again spill fuel out of fuel injector 30. As further discussed herein, by manipulating the relative timings of actuating spill valve 60 and control valve 68, thereby manipulating a timing of actuating direct-operated nozzle check 62, a rate shape of fuel injection from fuel injector 30 including a back end rate shape can be varied by selectively bleeding off of fuel pressure of plunger cavity 46, from one engine cycle to another.

Also depicted in FIG. 2 are features of control system 36, including rate shaping control unit 38. Rate shaping control unit 38 may include an engine control unit, or a dedicated fuel injection control unit in some embodiments. Rate shaping control unit 38 includes an input/output or I/O interface 74, coupled with a processor 76. Processor 76 can include any suitable central processing unit, for example a microprocessor or a microcontroller. Processor 76 is in communication with a computer readable memory 78, which can include any suitable computer readable memory such as RAM, ROM, SDRAM, EEPROM, FLASH, a hard drive, or still another. Stored on memory 78 are a plurality of maps referenced by processor 76 in controlling fuel injection, including fuel injection back end rate shaping, as discussed herein. Engine state sensor 40 of control system 36 may be structured to monitor any of a variety of different engine operating parameters, and may produce an engine state signal indicative of a present or observed value of the subject engine operating parameters, as further discussed herein.

In the illustrated embodiment, memory 78 stores a fuel or fueling map 80, and a dwell map 82. Rate shaping control unit 38 may be structured to determine a dwell time control term based on the engine state signal, and vary back end rate shape based on the dwell time control term. The dwell time control term could be a numerical term, directly or indirectly indicative of an actual dwell time duration, or another term directly or indirectly indicative of a property of fuel injection such as a back end rate shape, for example. Dwell table 82 may have as a coordinate an engine operating parameter indicated by the engine state signal, and rate shaping control unit 38 may be further structured to look up the dwell time control term from dwell map 82 based on the engine operating parameter. In one example embodiment, engine state sensor 40 can monitor engine speed. In additional or alternative instances, one or more engine state sensors can monitor requested load, fuel temperature, boost pressure, fuel quality, ambient temperature, ambient pressure, exhaust temperature, or any of a great variety of other parameters indicative of different engine states best managed with different back end rate shapes to mitigate certain emissions. For instance, it might be desirable to have a more square back end rate shape to rapidly cut off fuel injection in certain circumstances, but a descending ramp back end rate shape in other circumstances to more gradually cut off fuel injection. It is thus contemplated that in one engine cycle a first back end rate shape might be desirable, whereas in another engine cycle a different back end rate shape would be desirable. By monitoring one or more engine operating parameters, rate shaping control unit 38 can advantageously vary back end rate shape, from cycle to cycle as further discussed herein.

Rate shaping control unit 38 may be coupled with spill valve electrical actuator 58 and with control valve electrical actuator 66, and structured to command a change to an electrical energy state of spill valve electrical actuator 58 to open spill valve 60. Rate shaping control unit 38 may be further structured to command a change to an electrical energy state of control valve electrical actuator 66 to close check control valve 68, closing outlet check 62. Rate shaping control unit 38 is further structured to adjust a dwell time, from one cycle to another cycle, between the opening of spill valve 60 and the closing of check control valve 68, and to vary a back end rate shape, from one cycle to another cycle, of fuel injections from fuel injector 30 into cylinder 22 based on the adjustment to the dwell time. Rate shaping control unit 38 may also be structured to command energizing control valve electrical actuator 66 to fluidly connect check control chamber 48 to low pressure outlet 44, opening outlet check 62, as well as commanding deenergizing control valve electrical actuator 66 to block check control chamber 48 from low pressure outlet 44, closing outlet check 62. Rate shaping control unit 38 is also structured to command energizing spill valve electrical actuator 58 to close spill valve 60 and block plunger cavity 46 from fuel inlet passage 42, and to command deenergizing spill valve electrical actuator 58 to open spill valve 60 and fluidly connect plunger cavity 46 to fuel inlet passage 42. In one embodiment, spill valve electrical actuator 58 includes a first solenoid coil, and control valve electrical actuator 66 includes a second solenoid coil.

Rate shaping control unit 38 may be further structured to adjust the dwell time by advancing or retarding a timing of deenergizing of spill valve electrical actuator 58 relative to a timing of deenergizing of control valve electrical actuator 66, thereby advancing or retarding a timing of closing spill valve 60 relative to a timing of closing outlet check 62. In alternative embodiments, opening of spill valve 60 could be achieved by energizing an electrical actuator, and closing of spill valve 60 achieved by deenergizing an electrical actuator. Analogously, control valve electrical actuator 66 could be deenergized to open check control valve 68, and energized to close check control valve 68. In a practical implementation, deenergizing of spill valve electrical actuator 58 and deenergizing of control valve electrical actuator 66 each include decreasing electrical control currents to the respective spill valve electrical actuator 58 and control valve electrical actuator 66.

Figure 3:
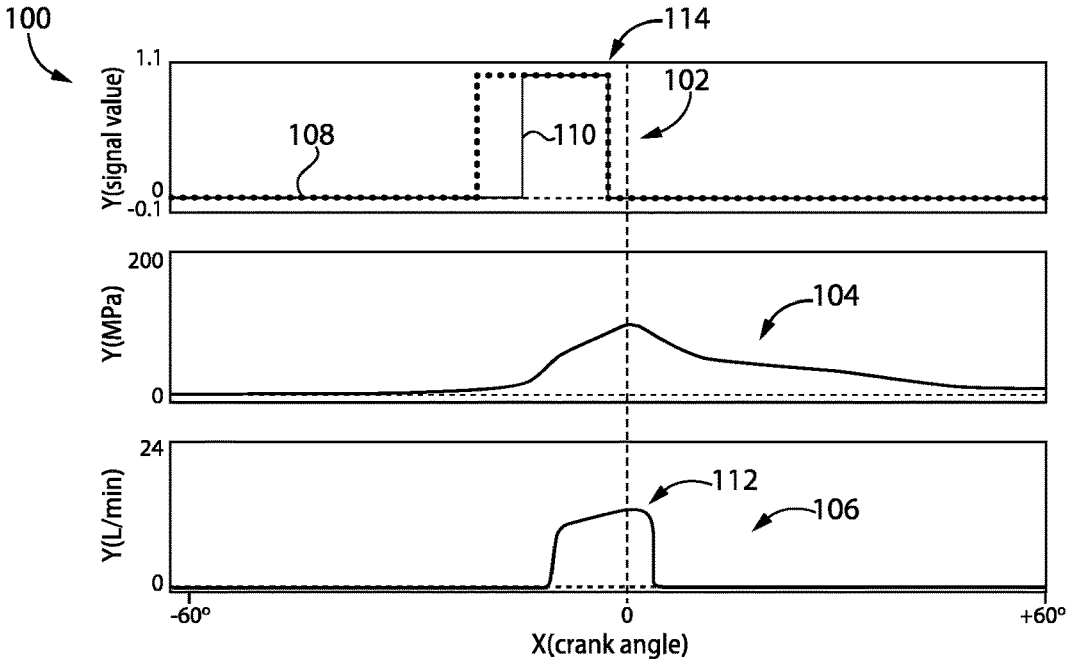
FIG. 3 is a graph showing signal traces of fuel injection properties, according to one embodiment.

Referring also now to FIG. 3, there is shown a graph 100 of fuel injection properties on the Y-axis in relation to crank angle on the X-axis. A first trace 102 shows an example first signal 108 controlling spill valve 60, and an example second signal 110 controlling check control valve 68. An injection pressure trace is shown at 104, and an injection rate trace is shown at 106. Reference numeral 112 identifies a back end rate shape of injection rate trace 106. In the example of graph 100, signal 108 can be seen to rise, energizing of spill valve electrical actuator 58, followed by a rise of signal 110, energizing of control valve electrical actuator 66. Each of signal 108 and signal 110 drops at approximately the same time, just before a 0° crank angle in the illustrated embodiment. Dwell time is substantially 0 in the example of FIG. 3, and is shown at reference numeral 114. Accordingly, rate shaping control unit 38 can be understood to command deenergizing spill valve electrical actuator 58 and command deenergizing control valve electrical actuator 66 at approximately the same time. The opening of spill valve 60 and the closing of check control valve 68 will generally occur at approximately the same time, although differing response times of the respective solenoids and/or control functions could exist and be compensated for to obtain simultaneous spill valve opening and control valve or outlet check closing, or to obtain non-simultaneous spill valve opening and control valve closing. Fuel system 16 could be tuned to compensate for differing response times.

Figure 4:
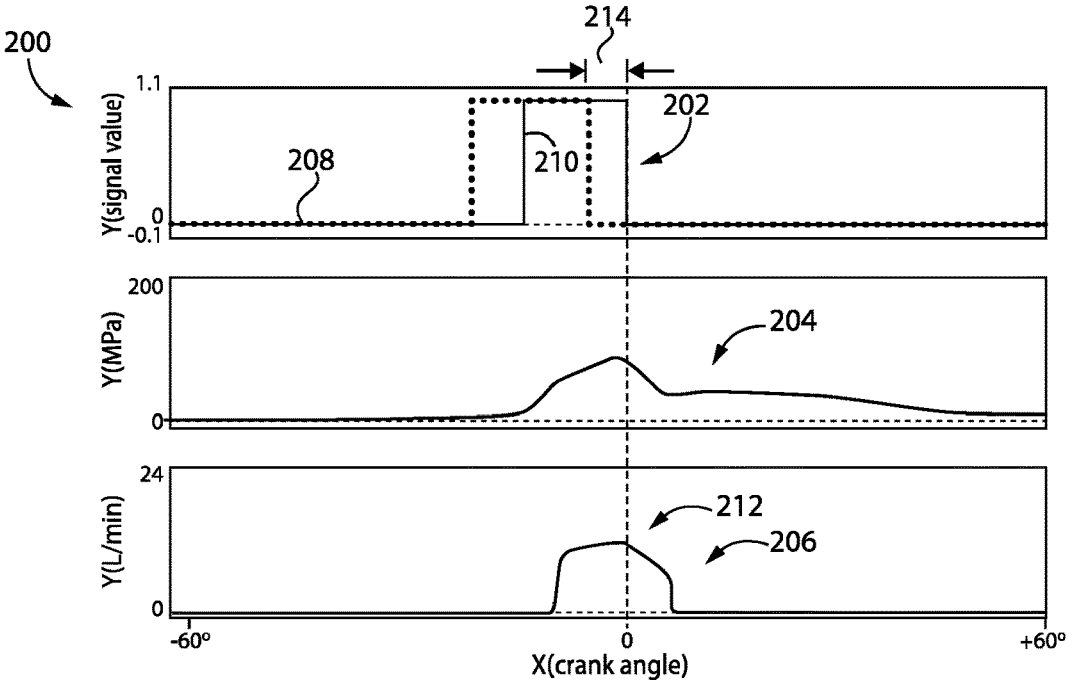
FIG. 4 is another graph showing signal traces of fuel injection properties, according to one embodiment.

Referring also now to FIG. 4, there is shown another graph 200, similar to graph 100, where a first trace is shown at 202 and includes a spill valve control signal 208 and a control valve control signal 210. An injection pressure trace is shown at 204, and an injection rate trace is shown at 206. Numeral 212 identifies a back end rate shape of rate trace 204. In the example of FIG. 4, a dwell time is shown at 214, and is a larger dwell time than that shown in the example of FIG. 3. It will be recalled that rate shaping control unit 38 varies a relative timing of opening spill valve 60 and closing check control valve 68. Adjusting of the dwell time includes advancing or retarding a timing of deenergizing spill valve electrical actuator 58 relative to a timing of deenergizing control valve electrical actuator 66. The state depicted in FIG. 4 as compared to the state depicted in FIG. 3 illustrates a case where a timing of deenergizing of spill valve electrical actuator 58 has been retarded relative to a timing of deenergizing of control valve electrical actuator 66. It can further be seen that retarding the timing of deenergizing spill valve electrical actuator 58 has varied a steepness of back end rate shape 212 of fuel injections between the FIG. 3 example and the FIG. 4 example. In particular, the advancing of the timing of commanding deenergizing spill valve electrical actuator 58 and thus closing spill valve 60 has increased a downslope steepness of back end rate shape 212 compared to back end rate shape 112.

It will further be appreciated from FIG. 3 and FIG. 4 that the timing of deenergizing spill valve electrical actuator 58 precedes the timing of deenergizing control valve electrical actuator 66. Advancing or retarding of the timing of deenergizing spill valve electrical actuator 58 relative to the timing of deenergizing control valve electrical actuator 66 may include advancing or retarding the timing in a dwell time range. The dwell time range may have a first endpoint, where the timing of deenergizing spill valve electrical actuator 58 precedes the timing of deenergizing control valve electrical actuator 66. The dwell time range can include a second endpoint where the respective timings are coincident, or substantially coincident. FIG. 3 represents an example case where the timings are coincident, and FIG. 4 represents an example case where the timing of deenergizing spill valve electrical actuator 58 and opening spill valve 60 precedes the timing of deenergizing control valve electrical actuator 66, and thus closing control valve 68 and outlet check 62.

Figure 5:
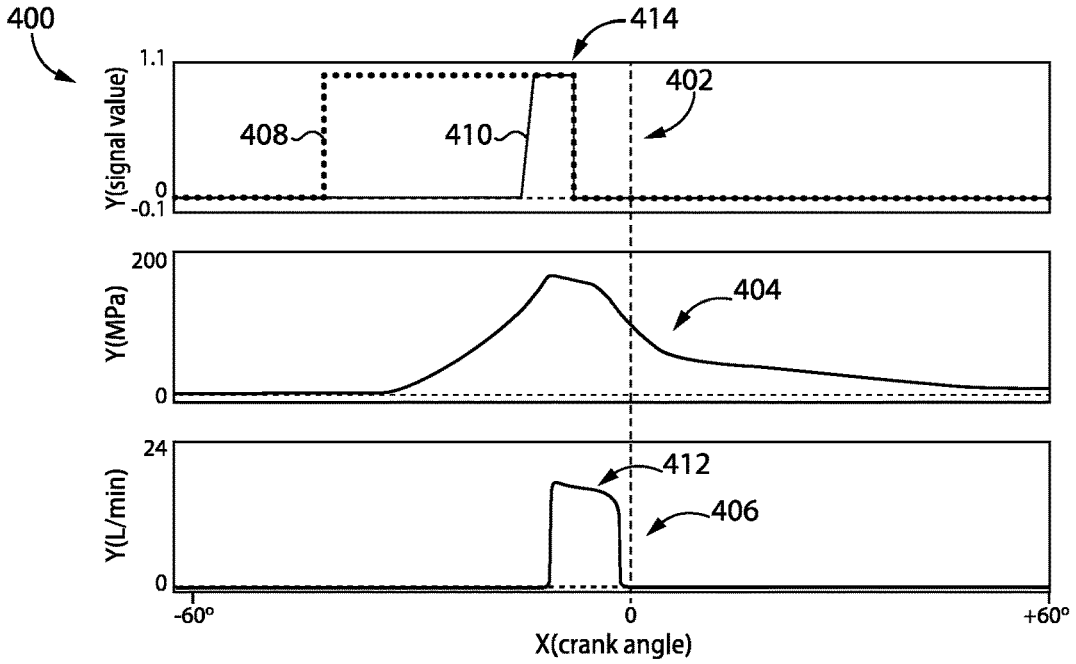
FIG. 5 is another graph showing signal traces of fuel injection properties, according to one embodiment.
Figure 6:
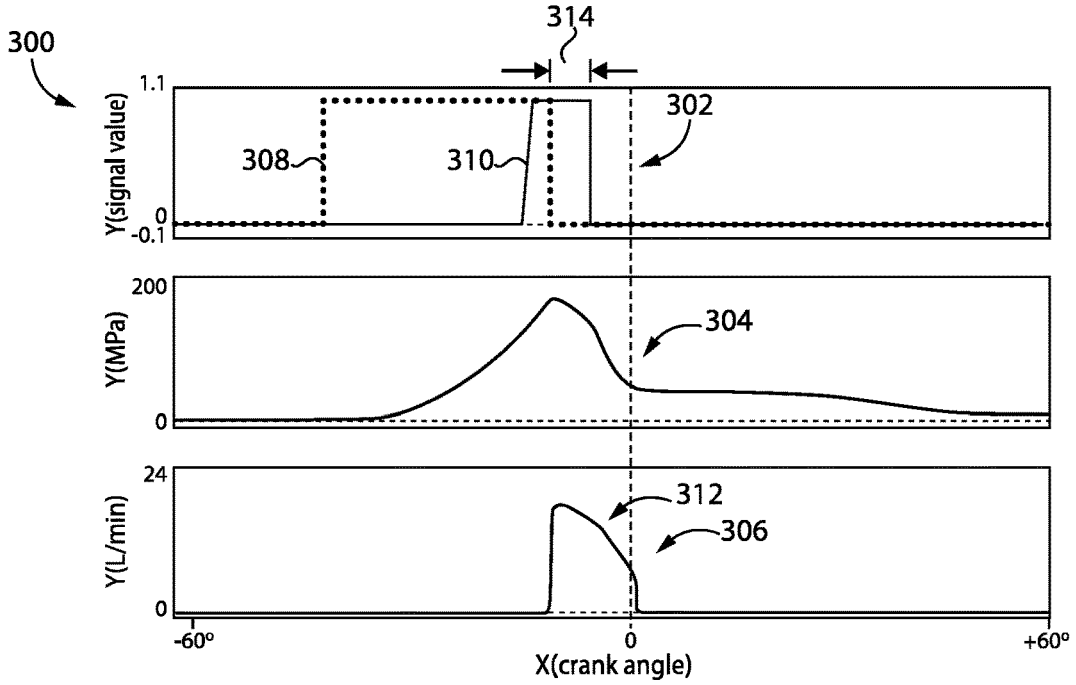
FIG. 6 is another graph showing signal traces of fuel injection properties, according to one embodiment.

Referring also now to FIG. 5, there is shown a graph 400 including a trace 402 of a spill valve control signal 408 and a control valve control signal 410. In FIG. 5 the timings of deenergizing the respective electrical actuators are coincident. Also in FIG. 5 an injection pressure trace is shown at 404, and a rate shape is shown at 406 having a back end rate shape 412. Referring also now to FIG. 6, there is shown a graph 300 having a trace 302 of a spill valve control signal 308 and a control valve control signal 310. An injection pressure trace is shown at 304, and an injection rate shape is shown at 306 and has a back end rate shape 312. From the case depicted in FIG. 5 to the case depicted in FIG. 6 it can be seen that a timing of the spill valve control signal 408, deenergizing spill valve electrical actuator 58, has been advanced relative to the timing of deenergizing control valve electrical actuator 66. Back end rate shape 312 is varied in steepness relative to back end rate shape 412, and increased in downslope steepness.

It will thus be appreciated in view of the present disclosure that varying dwell time can vary back end rate shape. Advancing a spill valve closing timing relative to a control valve closing timing can generally increase a rate shape back end downslope steepness, and vice versa. Rate shaping control unit 38 may be further structured to adjust, cycle to cycle, front end rate shapes of fuel injections from fuel injector 30. Adjusting front end rate shapes may be based on rate shaping control unit 38 adjusting, cycle to cycle, a start of injection pressure of fuel injections. In the case of FIG. 3 and FIG. 4 it can be seen from spill valve control signal 108 and spill valve control signal 208, respectively, that spill valve closing by way of energizing spill valve electrical actuator 58 occurs at approximately the same time in the two examples. The examples of FIG. 3 and FIG. 4 can be understood as a low start of injection pressure condition. In FIG. 5 and FIG. 6 it can be noted that spill valve control signal 408 and spill valve control signal 308 occur earlier in time in comparison to spill valve control signals 108 and 208 in FIG. 3 and FIG. 4, representing an earlier spill valve closing time. Closing spill valve 60 relatively earlier can enable plunger 52 to pressurize fuel to a relatively greater extent as compared to a later spill valve closing timing. Accordingly, it will be noted that a front end rate shape in examples of FIG. 3 and FIG. 4 is generally similar, but different from the front end rate shapes depicted in FIG. 5 and FIG. 6, and in the examples of FIGS. 5 and 6 the start of injection pressure is relatively high. The FIG. 3 and FIG. 4 examples each show an ascending front end ramp shape, whereas the front end ramp shape in the examples of FIG. 5 and FIG. 6 is a descending front end ramp shape. Those skilled in the art will appreciate other strategies for varying start of injection pressure, or other fuel injection and/or fuel delivery properties, as well as alternative front end and back end rate shapes that may be obtained in view of the present disclosure.

INDUSTRIAL APPLICABILITY

Figure 7:
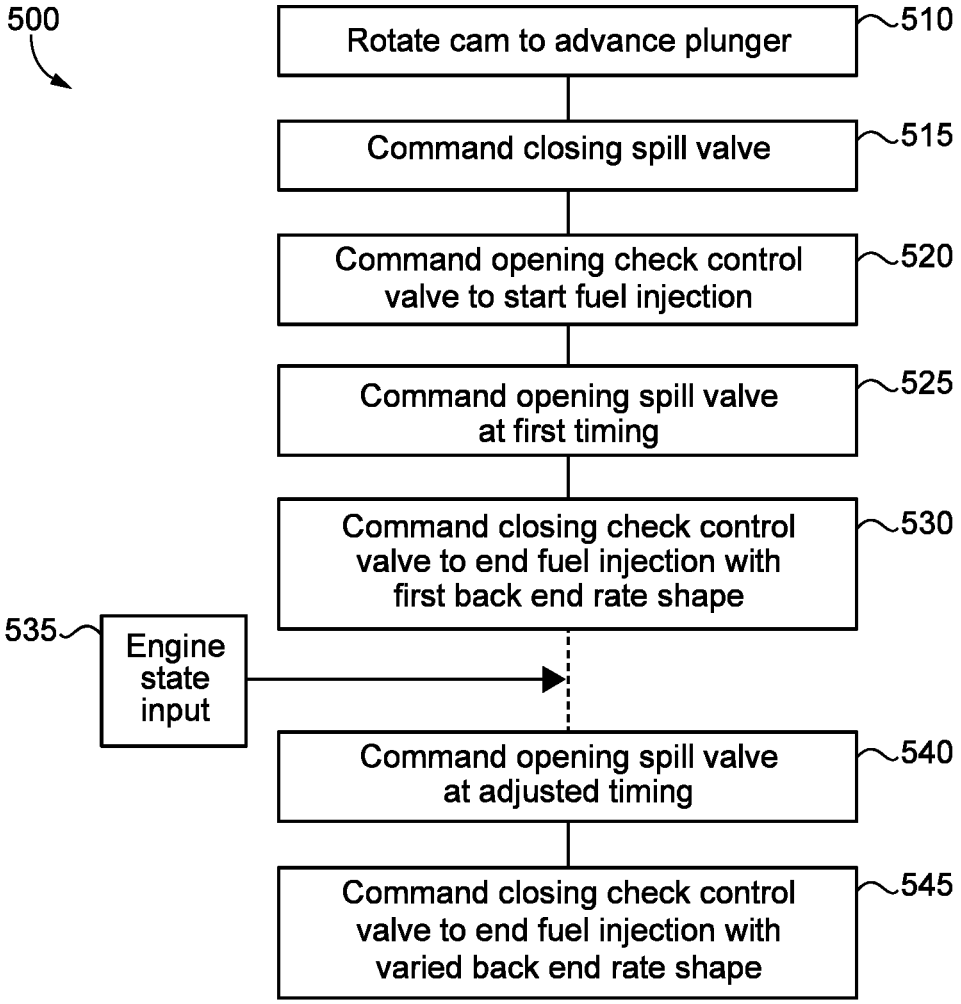
FIG. 7 is a flowchart illustrating methodology and control logic flow, according to one embodiment.

Referring to the drawings generally, but also now to FIG. 7, there is shown a flowchart 500 illustrating example methodology and control logic flow according to the present disclosure. Flowchart 500 begins at a block 510 to rotate a cam to advance a plunger, for instance rotating cams 26 and advancing plunger 52 in fuel injector 30. From block 510 flowchart 500 advances to a block 515 to command closing spill valve 60. From block 515 flowchart 500 advances to a block 520 to command opening check control valve 68 to open nozzle check 62 and start fuel injection. From block 520 flowchart 500 may advance to a block 525 to command opening spill valve 60 at a first timing, and thenceforth to a block 530 to command closing control valve 68, closing outlet check 62, and end fuel injection with a first back end rate shape.

From block 530, flowchart 500 advances to a block 540 to command opening spill valve 60 at an adjusted timing, and then to a block 545 to command closing control valve 68 to end fuel injection with a varied (different) back end rate shape, relative to the back end rate shape from block 530. Engine state inputs are shown at a block 535. It will be appreciated that from block 530 to block 540, cam 26 will be rotated to advance plunger 52, spill valve 60 will be commanded to close, and control valve 68 opened, analogous to blocks 510, 515, and 520. Inputting engine state input 535 thus represents changed engine operating conditions from one engine cycle to another that justify varying back end injection rate shape, as discussed herein.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed:

1. A fuel system comprising: a fuel injector including an injector housing having formed therein each of a fuel inlet passage, a low pressure outlet, a plunger cavity, a check control chamber, and a nozzle supply passage extending between the plunger cavity and a nozzle outlet; the fuel injector further including a plunger having a tappet with a cam actuated tappet surface exposed outside the injector housing and being movable between a retracted position, and an advanced position in the plunger cavity, a spill valve assembly including a spill valve electrical actuator, and a spill valve positioned fluidly between the plunger cavity and the fuel inlet passage, a direct-operated nozzle check positioned fluidly between the nozzle supply passage and the nozzle outlet, and a check control valve assembly including a control valve electrical actuator and a check control valve positioned fluidly between the check control chamber and the low pressure outlet; a rate shaping control unit coupled with the spill valve electrical actuator and with the control valve electrical actuator, the rate shaping control unit being structured to: command a change to an electrical energy state of the spill valve electrical actuator to open the spill valve; command a change to an electrical energy state of the control valve electrical actuator to close the check control valve and end an injection of fuel while the spill valve is open; adjust a dwell time, cycle to cycle, between the opening of the spill valve and the closing of the check control valve; and vary a back end rate shape, cycle to cycle, of fuel injections from the fuel injector into a cylinder in an engine based on the adjustment to the dwell time.

2. The fuel system of claim 1 wherein the rate shaping control unit is further structured to adjust the dwell time by advancing or retarding a timing of deenergizing of the spill valve electrical actuator relative to a timing of deenergizing of the control valve electrical actuator.

3. The fuel system of claim 2 wherein:

the spill valve electrical actuator includes a first solenoid coil, and the control valve electrical actuator includes a second solenoid coil; and the deenergizing of the spill valve electrical actuator and the deenergizing of the control valve electrical actuator each include decreasing electrical control currents to the respective first solenoid coil and second solenoid coil.

4. The fuel system of claim 2 wherein the advancing or retarding of the timing further includes advancing or retarding the timing in a dwell time range.

5. The fuel system of claim 4 wherein:

the timing of deenergizing the spill valve electrical actuator precedes the timing of deenergizing of the control valve electrical actuator at a first endpoint of the dwell time range; and the timing of deenergizing of the spill valve electrical actuator is coincident with the timing of deenergizing of the control valve electrical actuator at a second endpoint of the dwell time range.

6. The fuel system of claim 2 wherein the rate shaping control unit is further structured to vary a steepness of a back end rate shape of the fuel injections based on the advancing or retarding of the timing.

7. The fuel system of claim 6 wherein the rate shaping control unit is further structured to increase a downslope steepness of the back end rate shape based on advancing the timing of deenergizing of the spill valve electrical actuator.

8. The fuel system of claim 1 wherein the rate shaping control unit is further structured to adjust, cycle to cycle, front end rate shapes of the fuel injections from the fuel injector.

9. The fuel system of claim 8 wherein the rate shaping control unit is further structured to adjust, cycle to cycle, a start of injection pressure of the fuel injections, and the adjustment to the front end rate shapes is based on the varying of the start of injection pressure.

10. A method of operating a fuel system for an internal combustion engine comprising: advancing a plunger in a plunger cavity in a fuel injector in response to rotation of a cam on a tappet surface; closing a spill valve in the fuel injector to initiate pressurizing fuel in the plunger cavity during the advancing of the plunger in an engine cycle; opening a direct-operated nozzle check in the fuel injector to start injection of pressurized fuel from the fuel injector; opening the spill valve to end the pressurizing of fuel in the plunger cavity in the engine cycle; closing the direct-operated nozzle check to end the injection of pressurized fuel from the fuel injector; adjusting, cycle to cycle, a timing of the opening of the spill valve; adjusting, cycle to cycle, a timing of the closing of the direct-operated nozzle check; adjusting, cycle to cycle, and based on the adjustment to the timing of the opening of the spill valve and the adjustment to the timing of the closing of the direct-operated nozzle check, the timing of the opening of the spill valve relative to the timing of the closing of the direct-operated nozzle check; and varying, cycle to cycle, a back end rate shape of fuel injections from the fuel injector based on the adjustment to the timing of the opening of the spill valve relative to the timing of the closing of the direct-operated nozzle check; wherein the varying of the hack end rate shape includes varying a steepness of the back end rate shape.

11. The method of claim 10 further comprising varying, cycle to cycle, a bleeding off of fuel pressure of the plunger cavity based on the adjustment to the timing of the opening of the spill valve relative to the timing of the closing of the nozzle check.

12. The method of claim 11 wherein:

the closing of the direct-operated nozzle check includes deenergizing a solenoid coil in a control valve electrical actuator; and the adjustment to the timing of the opening of the spill valve includes an adjustment to a timing of deenergizing a solenoid coil in a spill valve electrical actuator.

13. The method of claim 10 wherein the adjustment to the timing of the opening of the spill valve includes advancing a timing of the opening of the spill valve relative to the timing of the closing of the direct-operated check, and the varying of the steepness includes increasing a downslope steepness of the back end rate shape.

14. The method of claim 10 further comprising varying, cycle to cycle, front end rate shapes of the fuel injections from the fuel injector.

15. The method of claim 14 further comprising adjusting, cycle to cycle, a start of injection pressure, and the varying of the front end rate shapes is based on the adjustment to the start of injection pressure.

16. The method of claim 15 wherein the adjustment to the start of injection pressure includes an adjustment to a timing of closing the spill valve.

17. A fuel control system for an internal combustion engine comprising: a rate shaping control unit structured to couple with each of a spill valve electrical actuator and a control valve electrical actuator in a mechanically actuated fuel injector due to a cam actuated tappet in a fuel system; the rate shaping control unit being further structured to command energizing the spill valve electrical actuator to block a plunger cavity from a fuel inlet passage in the fuel injector, and to command deenergizing the spill valve electrical actuator to fluidly connect the plunger cavity to the fuel inlet passage; the rate shaping control unit being further structured to command energizing the control valve electrical actuator to fluidly connect a check control chamber to a low pressure outlet in the fuel injector, and to command deenergizing the control valve electrical actuator to block the check control chamber from the low pressure outlet; the rate shaping control unit being further structured to: adjust a timing, cycle to cycle, of the commanded energizing of the spill valve electrical actuator to adjust an opening timing of the spill valve; adjust a timing, cycle to cycle, of the commanded deenergizing of the control valve electrical actuator to adjust a closing timing of an outlet check having a closing hydraulic surface exposed to the check control chamber, and the closing timing occurring while the spill valve is open; adjust a dwell time, cycle to cycle, between the commanded deenergizing of the control valve electrical actuator and the commanded energizing of the spill valve electrical actuator; vary a steepness of a back end rate shape, cycle to cycle, of fuel injections from the fuel injector into a cylinder in the internal combustion engine based on the adjustment to the dwell time.

18. The fuel control system of claim 17 further comprising an engine state sensor structured to produce an engine state signal, and the rate shaping control unit is coupled with the engine state sensor and further structured to determine a dwell time control term based on the engine state signal, and to vary the back end rate shape based on the dwell time control term.

19. The fuel control system of claim 18 further comprising a computer readable memory storing a dwell table having as a coordinate an engine operating parameter indicated by the engine state signal, and the rate shaping control unit is further structured to look up the dwell time control term based on the engine operating parameter.

* * * * *